US005367367A

United States Patent [19]

Ikeda et al.

[11] Patent Number: 5,367,367

[45] Date of Patent: Nov. 22, 1994

[54] TONER SUPPLYING MEMBER IN A DEVELOPING DEVICE USED IN AN IMAGE FORMING APPARATUS

[75] Inventors: Masae Ikeda; Hideki Kamaji; Kazunori Hirose, all of Kawasaki, Japan

[73] Assignee: Fujitsu Limited, Kawasaki, Japan

[21] Appl. No.: 946,418

[22] PCT Filed: Mar. 10, 1992

[86] PCT No.: PCT/JP92/00284

§ 371 Date: Nov. 6, 1992

§ 102(e) Date: Nov. 6, 1992

[87] PCT Pub. No.: WO92/15925

PCT Pub. Date: Sep. 17, 1992

[30] Foreign Application Priority Data

Mar. 11, 1991 [JP] Japan ..... 3-45228

[51] Int. Cl.[5] ..... G03G 15/06

[52] U.S. Cl. ..... 355/245; 118/653

[58] Field of Search ..... 355/245, 253, 259, 261; 118/651, 653, 661

[56] References Cited

U.S. PATENT DOCUMENTS 4,760,422 7/1988 Yano et al. ..... 355/245

FOREIGN PATENT DOCUMENTS 0388191 9/1990 European Pat. Off. .
56-70560 6/1981 Japan .
57-185052 11/1982 Japan .
59-231560 12/1984 Japan .
61-169859 7/1986 Japan .
61-238072 10/1986 Japan .
1-276170 11/1989 Japan .

*Primary Examiner*—Benjamin R. Fuller
*Assistant Examiner*—John Barlow
*Attorney, Agent, or Firm*—Staas & Halsey

[57] ABSTRACT

An image forming device supplies developing agent to developing portion for developing a latent image in devices such as those using electrophotography. A developing agent supplying body is formed of soft synthetic foam resin material imparted with conductivity, and imparted with physical properties such that a property of F, defined by $F=S\cdot\rho/H$, is between 72 and 114, where H is hardness, $\rho$ is density, and S is cell count of bubbles. Alternatively, the developing agent supplying body may be configured such that a moving speed of a developing agent supplying body at a contact surface is 1.4 to 1.7 times that of a developing agent transporting body. Both the above configurations ensure that an optimal amount of developing agent is supplied to the developing agent transporting body for transporting developing agent to the developing portion, thus allowing for good quality printing to be obtained.

16 Claims, 11 Drawing Sheets $(dt) = L2 - L1$

FIG. 10

| | ① | ② | ③ | ④ | ⑤ | ⑥ |
|---|---|---|---|---|---|---|
| DENSITY $\rho$ (Kg/m³) | 65 | 30 | 28 | 21 | 100 | 25 |
| HARDNESS H(kgf) | 20 | 12 | 12 | 13 | 68 | 10 |
| CELL COUNT S (CELLS/INCH) | UPWARD OF 40 | UPWARD OF 42 | 32~40 | UPWARD OF 40 | 80 | 17~23 |
| WORK FUNCTION W(eV) | 4.51<br>5.70 | 4.57 | 4.61 | 4.62 | 4.70<br>5.65 | 5.00 |
| TONER LAYER THICKNESS dt (μm) | 16.1 | 14.3 | 8.1 | 9.9 | 15.0 | 6.0 |

TONER SUPPLYING MEMBER IN A DEVELOPING DEVICE USED IN AN IMAGE FORMING APPARATUS

FIELD OF THE INVENTION

The present invention relates to an image forming device for supplying a developing agent to a developing portion for the purpose of developing a latent image in an electrophotographic device, for example.

An image forming device is used widely in printers, copying machines, and facsimile devices, for example, and a developing agent thereof must be in the form of a thin layer of uniform thickness when supplied to the developing portion, in order to perform good quality developing.

BACKGROUND ART

As a transporting the body for transporting developing agent to a developing portion, a developing roller with a circular cross-section is generally used, which roller is contacted by a rotating developing agent supplying roller so that the developing agent contained in a developing unit is supplied to the surface of the developing roller.

Therefore, in order to form a thin uniform layer of the developing agent on the surface of the developing roller, it is essential that the developing agent supplying roller supply the developing agent, an optimal amount at a time, to a contact portion contacted by the developing roller. Physical properties of the developing agent supplying roller thus becomes a very decisive factor.

As a material for such a developing agent supplying roller, polyurethane foam resin imparted with conductivity is used in the conventional technology. However, little attention is paid to the relationship between various physical properties of the material and the uniformity of the thickness of thin film of developing agent formed on the surface of the developing roller, except that a material of a suitable hardness is normally selected.

The supplying of the developing agent to the surface of the developing roller was performed, in the conventional technology, in such a way that the developing agent supplying roller was rotated at a peripheral speed (rotational speed measured at the edge of the roller) between 0.5 and 1 times that of the developing roller.

In the conventional technology, however, little consideration is given to the physical properties of the material of the developing agent supplying roller. In addition, the peripheral speed of the developing agent supplying roller is determined mainly in consideration of the occurrence of the splashing of developing agent inside a developing unit. Therefore, the purpose of making uniform the thickness of a thin film formed on the surface of the developing roller is not served.

Consequently, the conventional image forming device has a disadvantage in that, since the amount of developing agent carried by the developing agent supplying roller cannot be optimized, a thin film cannot be formed with uniform thickness on the surface of the developing roller, thereby causing bad quality printing, print history in which a printing pattern of the previous printing is retained, and uneveness in the darkness of printing.

Accordingly, the object of the present invention is to provide an image forming device having a developing agent supplying body capable of supplying an optimal amount of developing agent to a developing agent transporting body for transporting developing agent to a developing unit.

Another object of the present invention is to provide an image forming device capable of forming, on the surface of a developing agent transporting body, a uniform thickness thin film layer, of developing agent, by optimizing physical properties of the developing agent supplying body.

Still another object of the present invention is to provide an image forming device capable of forming, on the surface of a developing agent transporting body, a uniform thickness thin film layer of developing agent, by optimizing a moving speed of the developing agent supplying body, which speed is measured at a contact portion contacted by the developing agent transporting body.

SUMMARY OF THE INVENTION

To achieve the above objects, the image forming device of the present invention comprises a developing agent transporting body provided in a developing unit so as to transport the development agent. The developing agent consists of minute grains. The developing agent transporting body carries the developing agent to a developing portion on a surface of the developing agent transporting body;

The developing agent supplying body is contacted by the developing agent transporting body surface-to-surface on a contact surface and provides for supplying the developing agent, contained in the developing unit, to the surface of the developing agent transporting body by moving in a direction opposite to that of the developing agent transporting body at the contact portion.

The developing agent supplying body is made of soft synthetic foam resin material imparted with conductivity, having a property F maintained between the values of 72 and 114, F being defined by $F=S\cdot\rho/H$, where H is hardness (kgf), $\rho$ is density (kg/m$^3$), S is cell count (cells/inch).

The developing agent supplying body is alternatively configured such that its density $\rho$ (Kg/m$^3$) is between 28 and 30, its hardness H (Kgf) is between 9 and 15, and its cell count S (cells/inch) is between 32 and 42.

The developing agent supplying body can also be configured such that the value of the work function eV of the developing agent supplying body is smaller than the work function (eV) of the developing agent when the developing agent is negatively charged in actual operation.

The image forming device of the present invention comprises a developing agent transporting body provided in a developing unit so as to transport the developing agent consisting of minute grains, by carrying developing agent to a developing portion on a surface of developing agent transporting body.

The developing agent supplying body contacted is by the developing agent transporting body surface-to-surface on a contact surface and is provided for the supplying developing agent, contained in the developing unit, to the surface of the developing agent transporting body by moving in a direction opposite to that of the developing agent transporting body at the contact surface, the moving speed of the developing agent supplying body as measured at the contact surface is set to be from 1.4 to 1.7 times that of the developing agent transporting body.

Another configuration included in the present invention is such that the developing agent transporting body and the developing agent supplying body are both roller-like and have a circular cross section, and the peripheral speed of the developing agent supplying body is set to be from 1.4 to 1.7 times that of the developing agent transporting body.

In accordance with the present invention, an optimal amount of developing agent is supplied from the developing agent supplying body to the developing agent transporting body, by building a developing agent supplying body wherein $S \cdot \rho / H$ is between 72 and 114 and by adjusting the moving speed, at the contact portion, of the developing agent supplying body to be from 1.4 and 1.7 times that of the developing agent transporting body. Consequently, a uniform thickness thin film layer of developing agent is formed on the surface of the developing agent transporting body and is transported to the developing portion, thereby assuring a good quality printing.

BRIEF DESCRIPTION OF THE DRAWINGS

FIG. 10 is a table showing physical properties of materials used in experiments of the embodiment;

DESCRIPTION OF THE PREFERRED EMBODIMENTS

Figure 1:
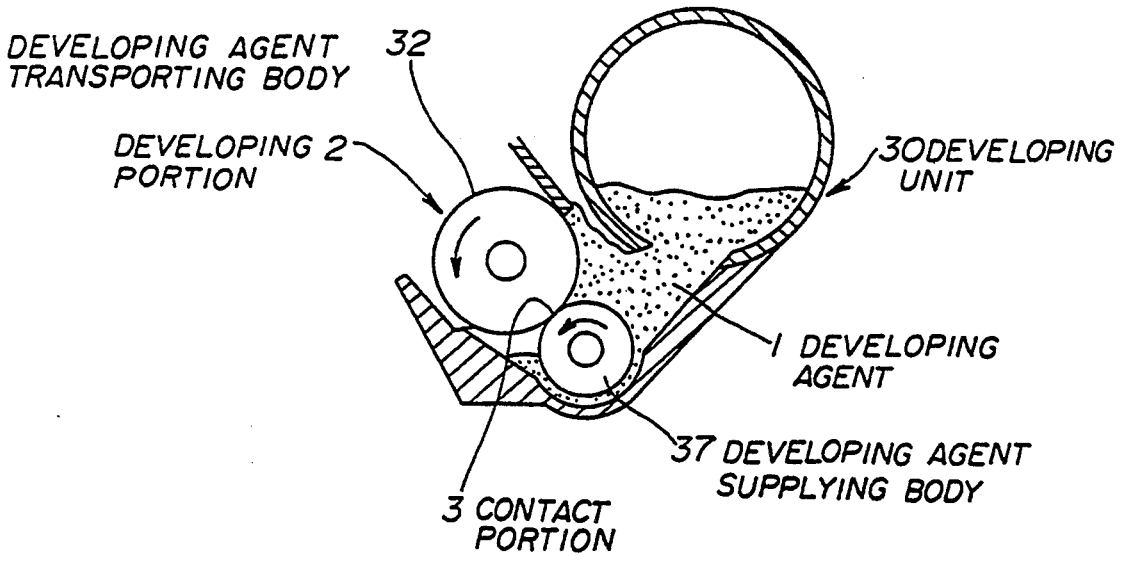
FIG. 1 is a view illustrating an assembly of the present invention.
Figure 2:
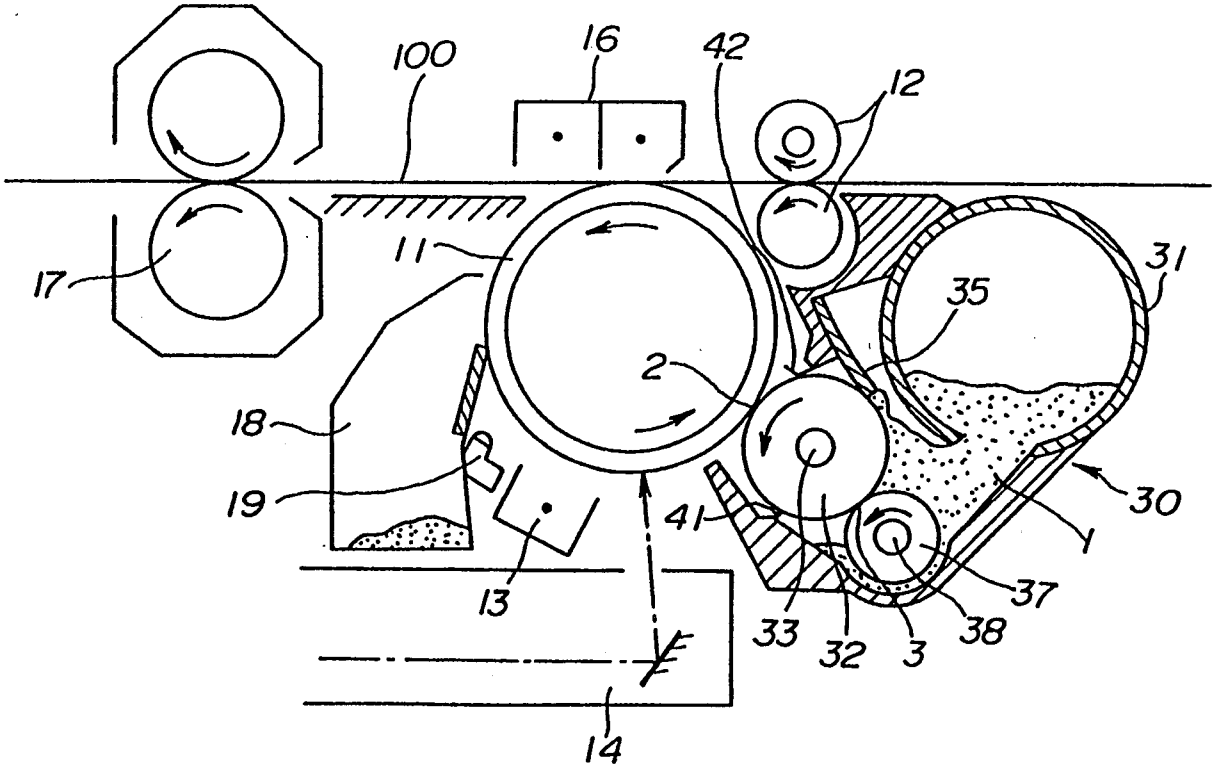
FIG. 2 is a view illustrating an assembly of an embodiment of the present invention.

A description of an embodiment of the present invention will be given in accordance with the diagrams. FIG. 1 is a view illustrating an assembly of the present invention and FIG. 2 illustrates a printer device in which the present invention is applied. It should be noted, however, that the present invention finds a wide application in various equipment employing an electrophotographic device, which equipment includes copying machines, facsimile machines, and electrostatic recording devices such as those employing a pin electrode or a dielectric drum.

Element 11 in FIG. 2 is a photosensitive drum that is rotationally operated by a motor, not shown in the figure, at the same peripheral speed as the transporting speed of printing paper 100 transported by a paper feed roller 12. This photoconductor drum 11 is configured such that a surface layer of polyurethane foam (trade name) infused with conductive carbon grain is adhesively formed over a core.

Element 13 is a precharger for charging the surface of the photosensitive drum 11 uniformly. Element 14 is an exposer for forming an electrostatic latent image on the photosensitive drum 11 surface by running laser light on the charged drum 11 surface. A scanner employing a hologram disk, for example, is available as a mechanism for running the laser light.

Electrostatic latent image on the photosensitive drum 11 surface is developed by a developing unit 30 of the present invention so as to form a toner image. Element 2 is a developing portion whereby the forming takes place.

A transfer 16 for transferring the toner image from the photosensitive drum 11 to the printing paper 16 is placed behind the printing paper 100 so as to face the contact portion formed between the photosensitive drum 11 and the printing paper 100.

Element 17 is a fixer for fixing the toner image onto the printing paper 100. Element 18 is a cleaner for cleaning the photosensitive drum 11 surface of residual toner. Element 19 is a erase lamp for eliminating static electricity from the photosensitive drum 11 surface.

The developing unit 30 is a single component developing unit and stores a toner 1 containing one kind of constituent as the developing agent. The toner 1 comprises minute grains with an average size of 12 μm; it comprises polyester resin toner of crosslinking polyester resin having such additives as azodyne dye, carbon black, and polypropylene wax. The toner, having a volume resistivity of $4 \times 10^{14}$ Ω cm, for example, and a work function of 5.5 eV, is negatively charged.

A developing roller 16 (developing agent transporting body) is rotationally operated so as to transport, from the developing unit 30, the toner 1, which toner is adhesively attached to the surface thereof and to develop, in the developing portion 2, an electrostatic latent image by means of the toner which is transported while being kept in contact with the photosensitive drum 11.

As for the material for the developing roller 32, substances such as polyurethane gum, silicon gum, and porous polyurethane sponge can be used when they are infused with a substance such as carbon, and thereby imparted with conductivity. In this embodiment, a porous polyurethane sponge is used (product name: polyurethane ultra minute continuous porous body of production by Toyo Polymer Inc. trade name: Rubicell) having a pore diameter of 10 μm, a cell count of about 200 cells/inch, a volume resistivity of $10^4 - 10^7$ Ω.cm, a hardness of 23 degrees (Ascar C hardness meter), a work function of 4.5 eV, and an applied voltage of −300V. The developing roller 32 as a whole has a resistance of about $10^5 - 10^7$ Ω. It is preferable that the rotation direction of the developing roller 32 be set to be in the same direction as the direction of the photosensitive drum 11. With this configuration, the surfaces of the developing roller 32 and the photosensitive drum 11 are moved in opposite directions, in the developing portion 2, while maintaining pressurized contact between themselves so that the film thickness of the toner 1 carried by the developing roller 32 is controlled within a specific range by pressure between the surfaces. It is assured thus that an appropriate thickness of toner layer is adhesively formed on the surface of the photosensitive drum 11.

Figure 3:
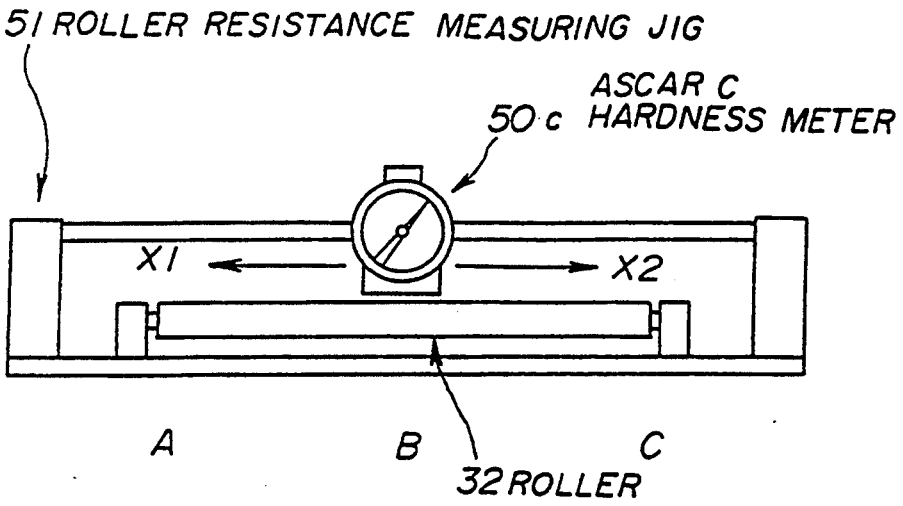
FIG. 3 is a diagram describing a method of measuring the roller hardness with an Ascar type C meter.

A description will be given below of a method for measuring the hardness and a method for measuring the resistance of the developing roller 32. First, a description of a method for measuring the hardness is given. The measurement of the hardness is carried out using a Ascar C hardness meter 50 shown in FIG. 3. This Ascar C hardness meter 50 is configured such that it can move in the directions X1 and X2 in the figure while being guided by the roller hardness measuring jig 51. The roller hardness measuring jig 51 is configured such that it can be fitted with a roller to be hardness-measured (the developing roller 32 in this case).

Onto three points designated by A, B, and C on the fitted developing roller 32, Ascar C hardness meter 50 is mounted and a hardness measurement (with a measuring load of 350 g) is taken at each of the three points.

Figure 4:
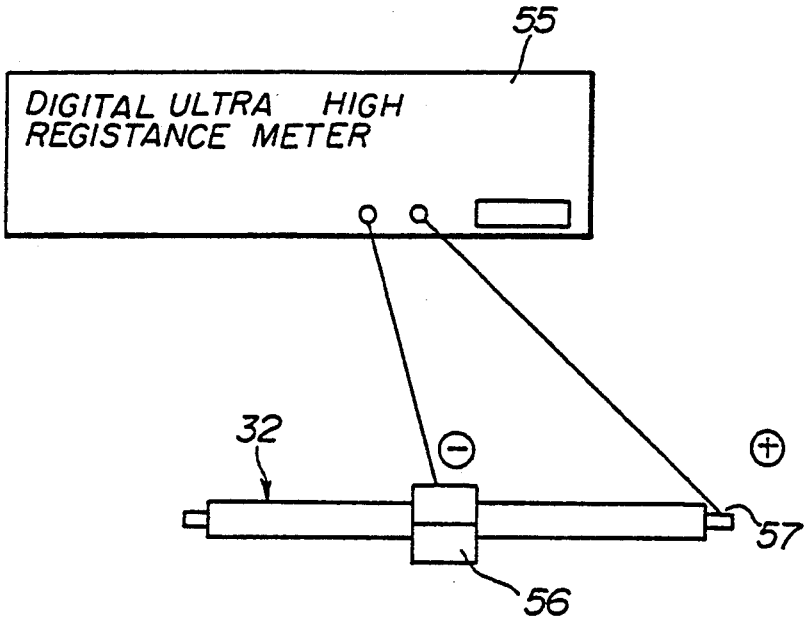
FIG. 4 is a diagram describing a method of measuring the roller resistance.

For measurement of the resistance of the developing roller 32, a digital ultra high resistance meter 55 shown in FIG. 4 is used. Specifically, a cathode 56 is connected to the center of the developing roller 32 and an anode 57 is connected to the end portion of the developing roller 32, a specified voltage (100V, for example) being applied across them. A measurement is then taken of a value of the electric current that flows across the electrodes. On the basis of the applied voltage and the measured value of the current, the resistance of the developing roller 32 is obtained as per the following equation:

$$\text{roller resistance } (\Omega) = \text{applied voltage/current value.}$$

Further description will be given in accordance with FIGS. 1 and 2 again. A rotation axis 33 of the developing roller 32 rotatably supports the developing roller 32. A voltage is applied to the roller 32 so that an electric field between the photosensitive drum 11 and the developing roller 32 the in image portion of the latent image has a polarity direction opposite to that of a background portion of the latent image. The voltage is adjusted so that the electric potential of the image portion of the photosensitive drum 11 is −100 volts, the electric potential of the background portion thereof is −600 volts, and the electric potential of the developing roller 32 is −300 volts.

Element 35 is a layer thickness control blade fixed so that it pressures the toner 1 against the surface of the roller 32 which is carrying the toner 1 from the developing unit 30 to the developing portion 2. A stainless steel blade spring with its tip face-milled so as to have a smooth round shape, for example, is used as a material for the layer thickness control blade.

Most of the toner 1 adhesively attached to the surface of the developing roller 32 in the developing unit 30 is scraped off at the pressure portion of this layer thickness control blade. By letting the toner 1 go through this portion, a thin layer of toner 1 of uniform thickness is formed on the surface of the developing roller 32 and is transported to the developing portion 2.

The pressuring force of the layer thickness control blade 35 against the developing roller 32 is 35 gf/cm, for example. A voltage of −400 volts, for example, is applied to the layer thickness control blade 35 so that the toner 1 is frictionally charged and so that the quantity of electric charge is maintained large enough. The work function of the pressuring force of the layer thickness control blade is configured to be 4.4 eV. As a material to build the layer thickness control plate 35, metals other than stainless steel, high polymer resin, silicon, urethane gum are available when they are treated so as to be conductive. Other materials are equally usable as long as they bear conductivity. The layer thickness control blade 35 acts to support the developing roller 32 in the trailing direction wherein the supporting takes place in the rotation direction of the developing roller 32, or in the counter direction wherein the supporting takes place in the direction opposite to the direction of rotation, as in this embodiment.

A reset roller 37 (developing agent supplying body) provided near the bottom of the developing unit 30 is allowed to rotate in combination with the developing roller 32. The reset roller 37 contacts with and rotates in the same direction as the developing roller 32. Therefore, the two rollers 32 and 37 travel in directions opposite to each other at the contact portion 3 formed between the developing roller 32 and the reset roller 37. With this configuration, the toner 1 is attached to the developing roller 32 by being pressed between the rollers 32 and 37. In this way the layer thickness of the toner 1 is controlled by the sandwiching pressure and a toner layer of uniform thickness can be formed.

Figure 5:
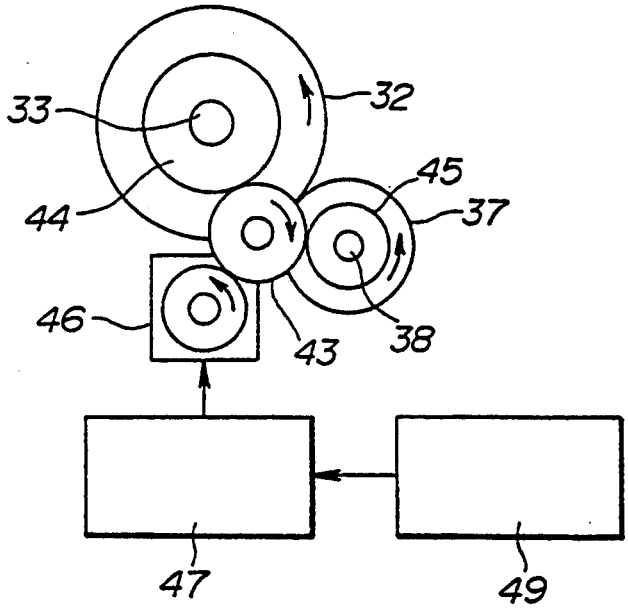
FIG. 5 is a schematic diagram of the embodiment.

FIG. 5 illustrates a driving mechanism of the developing roller 32 and the reset roller 37. Gears 44 and 45, which are fixed on axes 33 and 38 of the rollers 32 and 37, are rotationally driven in the same direction by a common stepping motor 46 via an intermediary gear 43. Element 49 is a controller for controlling the rotation of the stepping motor 46.

Referring back to FIG. 2, the reset roller 37 carries the toner 1, which is adhesively attached thereto, from the developing unit 30 to the contact portion 3 contacted by the developing roller 32, and scrapes off the residual toner 1 from the surface of the developing roller 32 after the development takes place. The work function of this reset roller 37 is set to charge the toner 1 negative. In this embodiment, the work function of the toner 1 is 5.5 eV, while the work function of the reset roller 37 is 4.6 eV.

The rotation axis of the reset roller 37 rotatably supports the reset roller 37. A voltage of −400 to −500 volts, for example, which is lower than that applied to the developing roller 32, is applied to the reset roller 37 so that the negatively charged toner 1 can be supplied developing roller 32 by both mechanical and electrical forces.

As a material for constructing the reset roller 37, a polyurethane sponge or brush infused with carbon, for example (so as to be conductive) is available. In this embodiment polyurethane sponge of a density $\rho$ of 28−30 kg/m$^3$, a hardness H of 9–15 kgf (hardness being determined according to JIS K 6401 hardness test), a cell count S of 32–42 cells/inch, and a volume resistivity of around $10^4$ Ω cm are used.

Experiments were carried out to determine a reset roller 37 configuration for providing a toner 1 layer having a uniform thickness, suitable for allowing good quality printing, on the surface of the developing roller 32.

Figure 6:
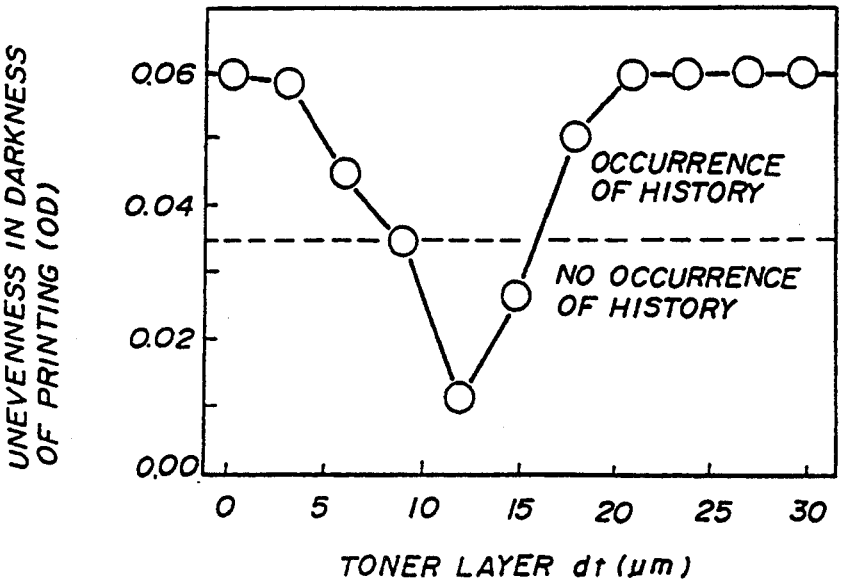
FIG. 6 is a graph showing experimental data of the embodiment.

FIG. 6 describes the state after the printing is done on the printing paper 100, and shows a relationship between unevenness in darkness of printing on a sheet of printing paper 100, and the corresponding toner layer thickness (dt) on the surface of the developing roller 32.

As shown in this FIG. 6, in order to maintain unevenness in darkness of printing at a level not accompanying printing history, the toner layer thickness dt should be kept within the range of 9–16 μm.

Figure 7:
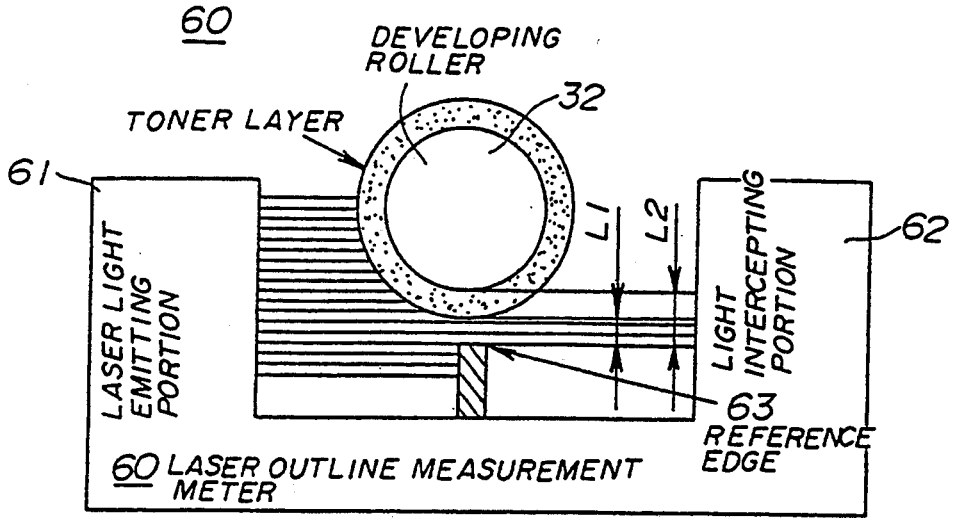
FIG. 7 is a diagram describing a method for measuring thickness of a toner layer.

The toner layer thickness dt is measured by using a laser outline measurement equipment 60 as shown in FIG. 7. This laser outline measurement equipment 60 comprises a laser light emitting portion 61 which emits parallel rays of laser light, a light intercepting portion 62 for intercepting the laser light, and a reference edge 63; the developing roller 32 being disposed between the laser light emitting portion 61 and the light intercepting portion 62. This allows the measuring of distances $L_1$ and $L_2$, $L_2$ being the separation of a position of the developing roller 32 from a reference position set by the reference edge 63 blocking the laser light, $L_1$ being the width of the laser light intercepted by the intercepting portion 62. The difference dt between $L_1$ and $L_2$ ($dt=L_2-L_1$) gives the toner layer thickness dt. The determination of the occurrence of printing history used in obtaining the FIG. 6 graph was made according to a visual test by a plurality of testers (people), whereby if any one of the testers recognized an occurrence of printing history, an occurrence of printing history was recorded.

Figure 8:
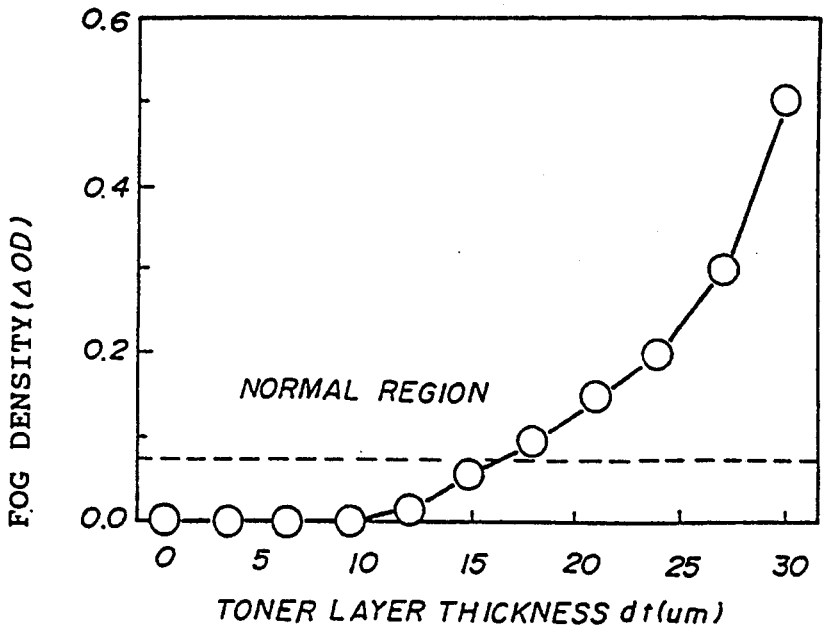
FIG. 8 is a graph showing experimental data of the embodiment.

FIG. 8 shows the relationship between printing marks and toner layer thickness dt. FIG. 8 shows that to keep the printing mark level within an acceptable region it is required that the toner layer thickness dt be smaller than 15 μm.

Figure 9:
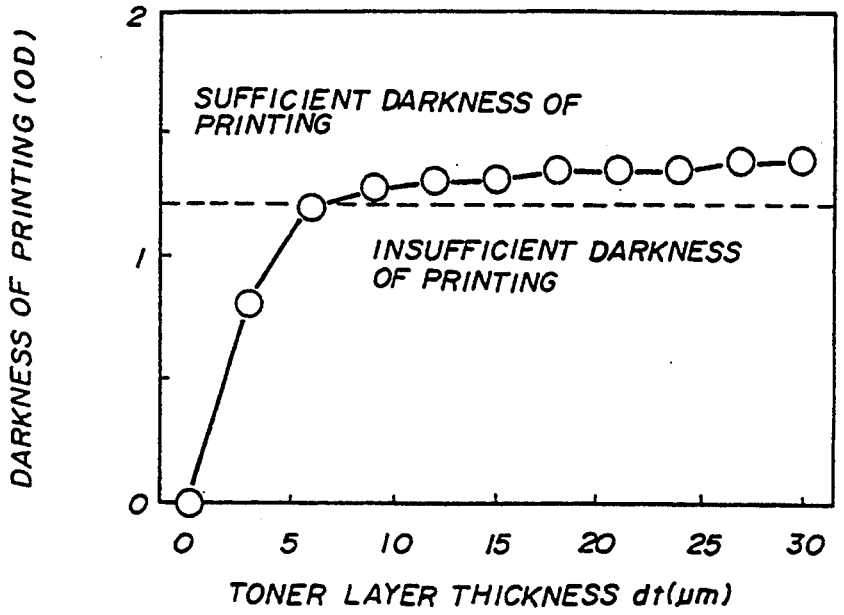
FIG. 9 is a graph showing experimental data of the embodiment.

FIG. 9 shows a relationship between darkness of printing and toner layer thickness dt. It is apparent that a toner layer thickness dt of more than 7 μm is required in order to ensure sufficient darkness of printing.

Thus the data in FIGS. 6, 8, and 9, show that a toner layer thickness dt of 9–15 μm is required in order to obtain optimal printing results satisfactory in all three aspects; unevenness in darkness of printing (history), printing marks, and darkness of printing.

Measurement was made, as shown in FIG. 10, of the toner layer thickness dt formed on developing rollers 32, while varying the construction material thereof: six kinds (①–⑥) of carbon-infused polyurethane sponge (polyurethane foam having continuous porosity) were used as material for the reset roller 37. The peripheral speed of the reset roller 37 was set at 1.5 times that of the developing roller 32.

Specifically, the six kinds (①–⑥) of polyurethane sponge include three kinds of esters of polyurethane foam ①–③, namely ① high-density type esters polyurethane foam (material reference: ST), ② high-elasticity type esters polyurethane foam (material reference: SF), ③ general-purpose type esters polyurethane foam (material reference: SK). The remaining materials ④–⑥ include ④ general-purpose type polyethers polyurethane foam (material reference: TS), ⑤ conductive type urethane foam (material reference: EP), and ⑥ specially processed polyurethane foam with film-like substance completely removed (material reference: HR-20).

On the basis of three physical properties shown in FIG. 10, namely density $\rho$ (kg/m$^3$) hardness H (kgf), and cell count S (cells/inch), F is defined as $F=S\cdot\rho/H$. When F was plotted against the toner layer thickness dt, the relationship between F and dt was founded to be stable, and was represented, as shown in FIG. 11, as a straight line, for which line the equation $dt=0.14F-1$ was obtained.

Figure 11:
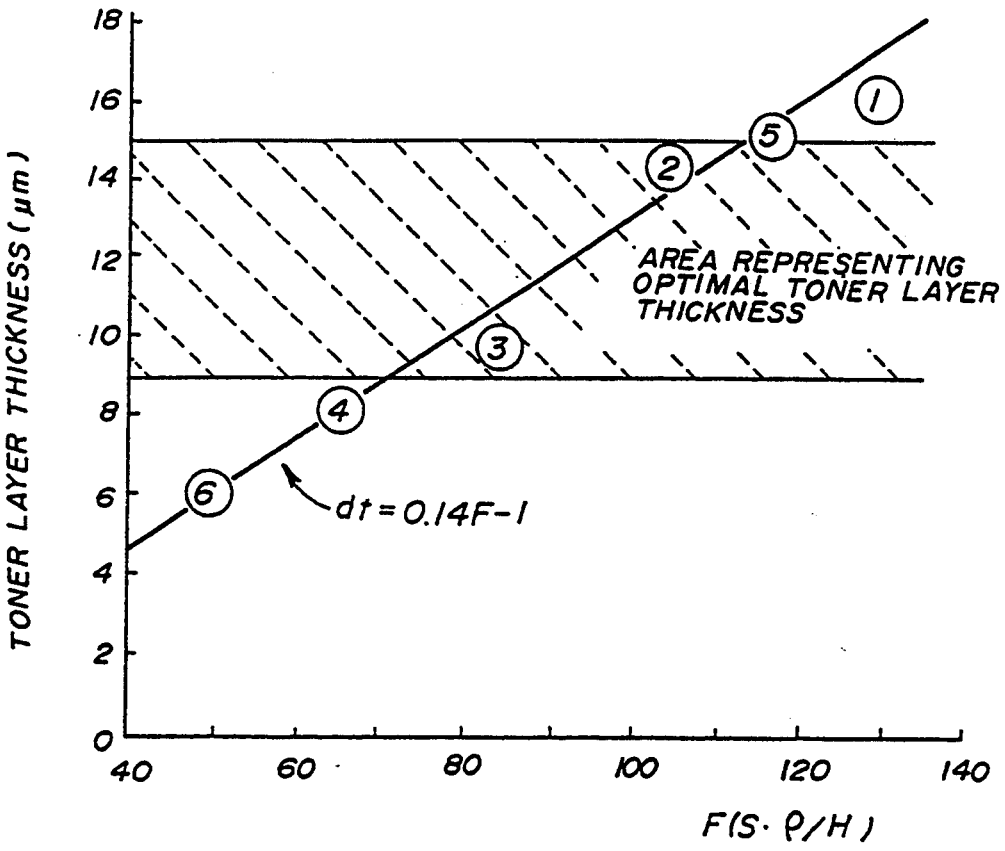
FIG. 11 is a graph showing correlation between toner layer thickness and physical properties.

It is demonstrable from FIG. 11 that when F is maintained within the range of 72–114, the optimal toner layer thickness dt of 9–15 μm is obtained.

When applying this to actual factory products, it is even more preferable that F be maintained within the range of 79–107 so that the toner layer thickness dt is 10–14 μm, in consideration of the presence of other factors causing variations.

Experiments were also carried out to determine the relationship between the peripheral speed ratio and the darkness of printing, the peripheral speed ratio being the ratio of the peripheral speed of the reset roller 37 to the peripheral speed of the developing roller 32, whereby the above-mentioned substance ⑧ was used to build the reset roller 37. Adjustment of the peripheral speed ratio was done by changing the numbers of teeth of the gears shown in FIG. 5.

Figure 12:
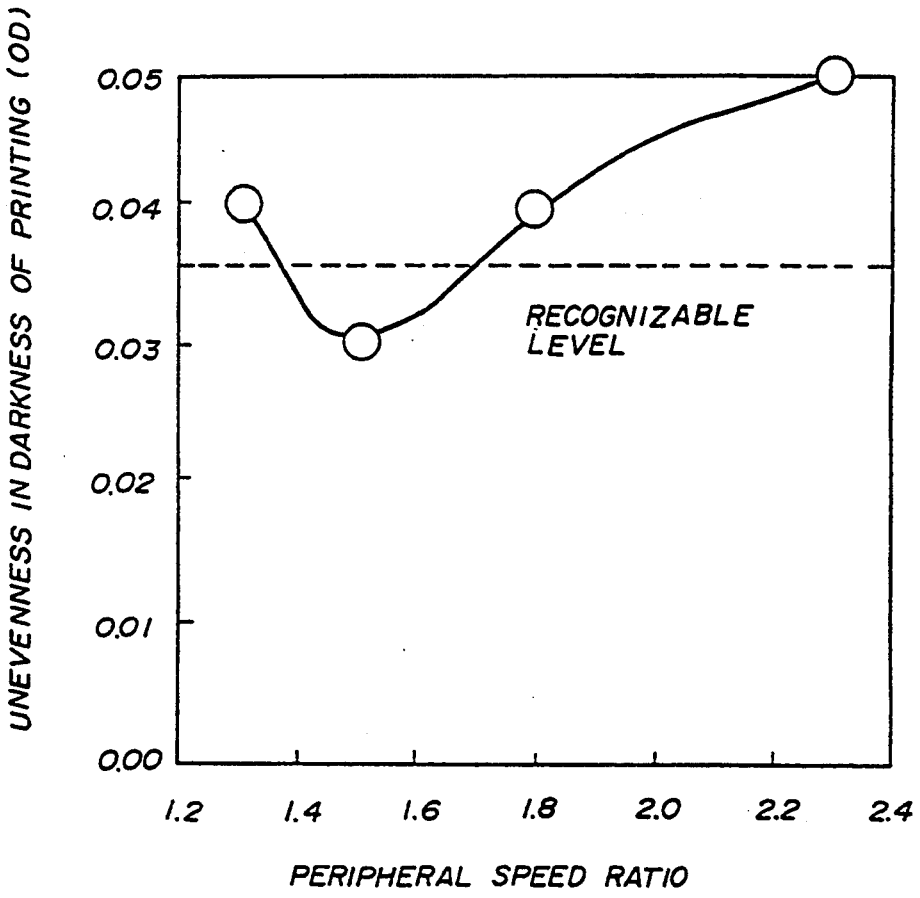
FIG. 12 is a graph showing experimental data of the embodiment.

FIG. 12 shows the result of the experiments, indicating that when the peripheral speed of the reset roller 37 is maintained between 1.4–1.7 times that of the developing roller 32, unevenness in darkness of printing is kept below a discernible level, and that a ratio of 1.5 provides the best results.

Figure 13:
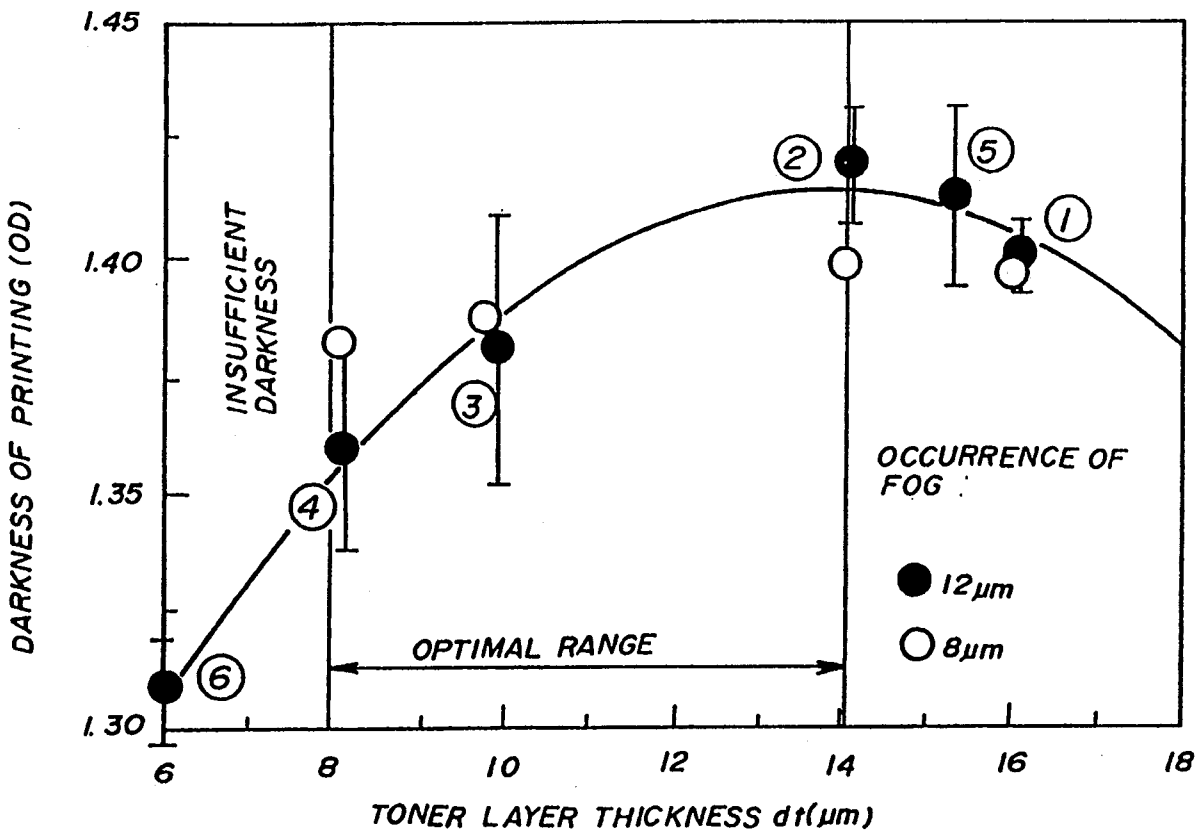
FIG. 13 is a diagram showing the relationship between toner layer thickness for toners of different grain sizes, and darkness of printing.

While in the above embodiment, the use of the toner 1 having an average grain size of 12 μm was assumed, variations in the toner's average grain size do not hinder effectiveness of the present invention. FIG. 13 shows the results of experiments proving this point.

FIG. 13 was obtained by using the substances shown in FIG. 10, providing toners having an average grain size of 12 μm and 8 μm , determining the relationship between the toner layer thickness dt and the darkness of printing, and charting the results on the same graph. Black dots in the figure represent the 12 μm toner, and white dots represent the 8 μm toner.

Figure 14:
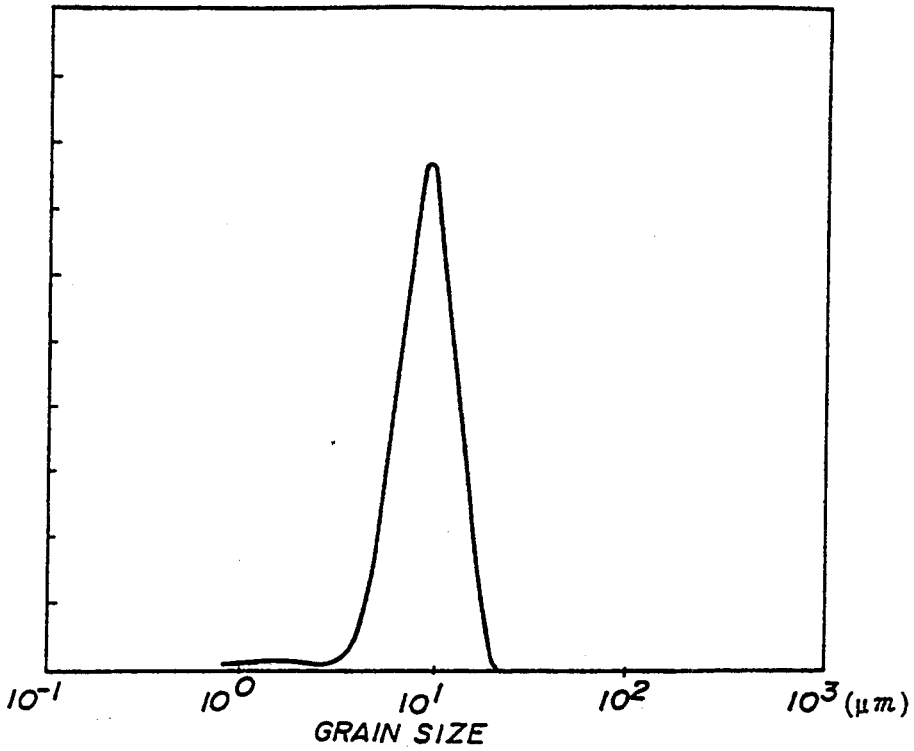
FIG. 14 is a graph showing an atomizing distribution of 8 μm toner.
Figure 15:
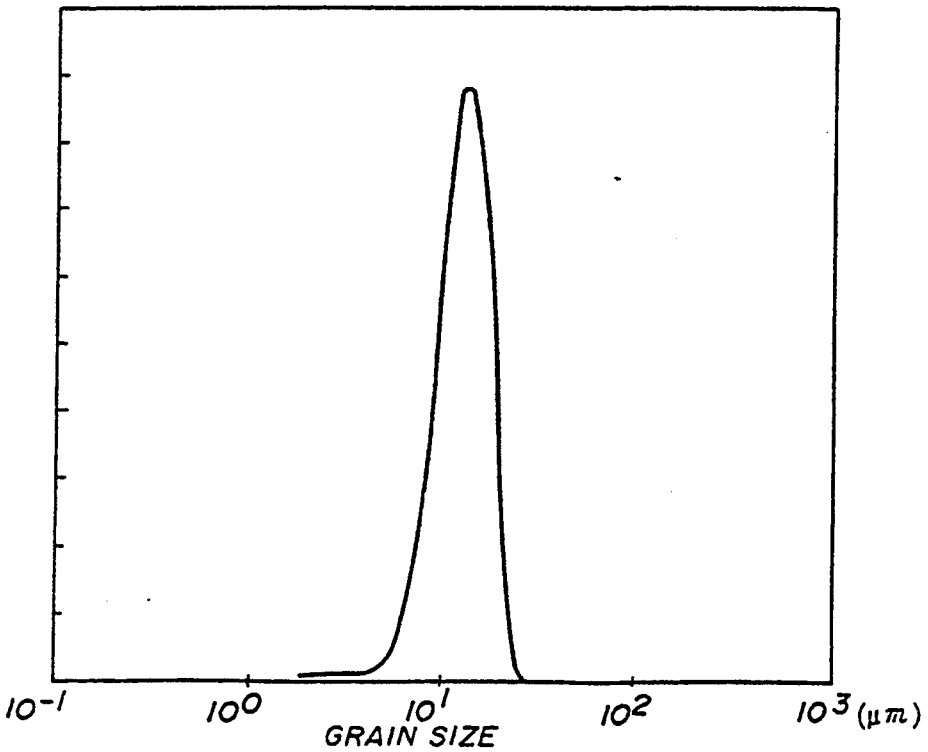
FIG. 15 is a graph showing an atomizing distribution of 12 μm toner.

It may be seen from the figure that, for each kind of material, the 12 μm toner and 8 μm toner exhibit almost the same behavior, and that the toner layer thickness dt does not depend on the toner grain size. Consequently, it was demonstrated that the optimal toner layer thickness and the reset roller 37 peripheral speed do not depend on the toner grain size. FIG. 14 shows an atomizing distribution of the 8 μm toner used in these experiments, and FIG. 15 shows that of the 12 μm toner used in these experiments. Average grain size was calculated as an average for a specified volume. It was found to be 8.8 μm for the 8 μm toner, and 12.68 μm for the 12 μm toner.

While in the above embodiment roller-like bodies were used for the developing agent transporting body 32 and the developing agent supplying body 37, the present invention is not limited to these forms but can be applied to other forms such as belt conveyors.

As shown above, in accordance with the image forming device of the present invention, a thin film of developing agent having a uniform thickness can be formed on the surface of a developing agent transporting body, by supplying an optimal amount of developing agent to the developing agent transporting body by a developing agent supplying body, thereby allowing good printing quality on a constant basis to be obtained.

We claim:

1. An image forming device comprising:

a developing unit comprising a developing portion and a developing agent transporting body having a first surface, said developing agent transporting body transporting a developing agent from a supply thereof contained in the developing unit, the developing agent comprising minute grains, by carrying said developing agent to the developing portion on the first surface of the developing agent transporting body;

a developing agent supplying body having a second surface contacting said developing agent transporting body with the respective first and second surfaces thereof in surface-to-surface contact, said developing agent supplying body supplying the developing agent, contained in said developing unit, to the first surface of said developing agent transporting body by moving in a direction opposite to that of said developing agent transporting body at said surface-to-surface contact therewith; and said second surface of said developing agent supplying body being made of a conductive soft synthetic foam resin material, having a property of F maintained between the values of 72 and 114, F being defined by $F=S\cdot\rho/H$, where H is hardness in kgf, $\rho$ is density in $kg/m^3$, and S is cell count in cells/inch.

2. An image forming device as claimed in claim 1, wherein the density of the of said developing agent supplying body is maintained within a range of 28–30 $kg/m^3$.

3. An image forming device as claimed in claim 1, wherein the hardness of the second surface of said developing agent supplying body is maintained within a range of 9–15 kgf.

4. An image forming device as claimed in claim 2, wherein the hardness of said second surface of said developing agent supplying body is maintained within a range of 9–15 kgf.

5. An image forming device as claimed in claim 1, wherein the cell count of said second surface of said developing agent supplying body is maintained within a range of 32–42 cells/inch.

6. An image forming device as claimed in claim 2, wherein the cell count of said second surface of said developing agent supplying body is maintained within a range of 32–42 cells/inch.

7. An image forming device as claimed in claim 3, wherein the cell count of said second surface of said developing agent supplying body is maintained within a range of 32–42 cells/inch.

8. An image forming device as claimed in claim 4, wherein the cell count of said second surface of said developing agent supplying body is maintained within a range of 32–42 cells/inch.

9. An image forming device as claimed in claim 1, wherein a work function in of said second surface of said developing agent supplying body has a value smaller than a work function in of said developing agent when said developing agent is negatively charged in actual operation.

10. An image forming device as claimed in claim 2, wherein a work function in of said second surface of said developing agent supplying body has a value smaller than a work function in of said developing agent when said developing agent is negatively charged in actual operation.

11. An image forming device as claimed in claim 3, wherein a work function in of said second surface of said developing agent supplying body has a value smaller than a work function in of said developing agent when said developing agent is negatively charged in actual operation.

12. An image forming device as claimed in claim 4, wherein a work function in of said signed surface of said developing agent supplying body has a value smaller than a work function in of said developing agent when said developing agent is negatively charged in actual operation.

13. An image forming device as claimed in claim 5, wherein a work function in of said second surface of said developing agent supplying body has a value smaller than a work function in of said developing agent when said developing agent is negatively charged in actual operation.

14. An image forming device as claimed in claim 6, wherein a work function in of said second surface of said developing agent supplying body has a value smaller than a work function in of said developing agent when said developing agent is negatively charged in actual operation.

15. An image forming device as claimed in claim 7, wherein a work function in of said second surface of said developing agent supplying body has a value smaller than a work function in of said developing agent when said developing agent is negatively charged in actual operation.

16. An image forming device as claimed in claim 8, wherein a work function in of said second surface of said developing agent supplying body has a value smaller than a work function in of said developing agent when said developing agent is negatively charged in actual operation.

* * * * *

UNITED STATES PATENT AND TRADEMARK OFFICE

CERTIFICATE OF CORRECTION

PATENT NO. : 5,367,367

DATED : November 22, 1994

INVENTOR(S) : Masae IKEDA et al.

It is certified that error appears in the above-indentified patent and that said Letters Patent is hereby corrected as shown below:

Col. 1, Line 19, delete "the", and insert --the-- after "transporting".

Col. 2, Line 27, change ";" to --.--.

Col. 2, Line 55, insert --the-- after "carrying".

Col. 2, Line 58, after "body" insert --is--; and delete "is" after "contacted".

Col. 6, Line 50, after "or" insert --a--.

Col. 6, Line 52, after "embodiment" insert --a--.

Col. 7, Line 9, change ";" to --,--.

Col. 7, Line 13, after "32" insert --(i.e., the circumferentine surface thereof)--.

Col. 9, Line 25, after "the" (second occurrence) insert --second surface--.

Signed and Sealed this

Thirteenth Day of June, 1995

*Attest:*

Bruce Lehman

BRUCE LEHMAN

*Attesting Officer*

*Commissioner of Patents and Trademarks*